US006735825B1

(12) United States Patent
Berman et al.

(10) Patent No.: US 6,735,825 B1
(45) Date of Patent: May 18, 2004

(54) SECURED PEN AND HOLDER

(76) Inventors: James Berman, 160 E. 93rd St., New York, NY (US) 10128; Ben Aaron Berman, 160 E. 93rd St., New York, NY (US) 10128

( * ) Notice: Subject to any disclaimer, the term of this patent is extended or adjusted under 35 U.S.C. 154(b) by 0 days.

(21) Appl. No.: 10/298,411

(22) Filed: Nov. 18, 2002

(51) Int. Cl.[7] ..... A44B 21/00; A45F 5/02

(52) U.S. Cl. ..... 24/3.13; 24/10 R; 24/11 CT; 24/11 F; 211/69.1; 211/69.5; 401/88; 401/195

(58) Field of Search ..... 24/3.13, 10 R, 24/11 CT, 11 F; 211/69.1, 69.5; 401/88, 195

(56) References Cited

U.S. PATENT DOCUMENTS

| | | | | |
|---|---|---|---|---|
| 1,462,108 A | | 7/1923 | Holywell | |
| 1,511,167 A | | 10/1924 | Jesnig | |
| 2,853,054 A | | 9/1958 | Rosa | |
| 3,570,284 A | | 3/1971 | Hendricks | |
| 4,519,514 A | * | 5/1985 | Agbay et al. | 215/225 |
| 4,699,536 A | | 10/1987 | Berman | |
| 5,123,548 A | | 6/1992 | Milne | |
| 5,178,285 A | * | 1/1993 | Soucy | 211/69.5 |
| 5,263,593 A | * | 11/1993 | Aida | 211/69.1 |
| 5,699,591 A | | 12/1997 | Kane | |
| 5,839,712 A | * | 11/1998 | Wang | 248/316.2 |
| 6,167,596 B1 | | 1/2001 | Berman | |
| 6,243,921 B1 | * | 6/2001 | Chang | 24/3.13 |
| 6,575,649 B1 | * | 6/2003 | Kuan-Hsiung et al. | 401/131 |
| 6,582,514 B1 | * | 6/2003 | Yang | 118/76 |

* cited by examiner

*Primary Examiner*—Victor Sakran
(74) *Attorney, Agent, or Firm*—Reed Smith LLP

(57) ABSTRACT

In the secured pen holder of U.S. Pat. No. 6,167,596, a first resilient engagement between cover and base provides an indication of the replacement state in which the pen assembly can be replaced. A second resilient engagement between cover and base provides an indication of the use position in which the pen is held within the holder for use. A third resilient engagement between transport and base provides an indication that the transport is resiliently held in place at a position when the transport wall holds the pen tether and stop in place during the use state.

15 Claims, 7 Drawing Sheets

SECURED PEN AND HOLDER

BACKGROUND OF THE INVENTION

This invention relates in general to an improvement in the secured pen and pen holder arrangement disclosed in U.S. Pat. No. 6,167,596 issued Jan. 2, 2001.

This invention relates primarily to three specific improvements in the invention described in said '596 patent. Thus, the disclosure of the '596 patent is incorporated herein by reference. Comparable reference numbers will be used where feasible in order to facilitate cross-reference.

In the '596 design, the transport element 24 is free to rotate when the pen and pen holder is in its use state, which is the state wherein the user would be using the pen. Transport element rotation could cause an alignment which would facilitate accidental, or even intentional, removal of the pen.

Furthermore, in that '596 design, the cover is substantially free to rotate. This requires careful positioning of the cover when replacing the pen and can also result in a distracting jolting of the tether when the pen is in use.

There is also the possibility when the pen is pulled hard enough, that the stop of the pen can wedge into the slot 40 in the base making it difficult to move the pen from its use state to its replacement state.

Accordingly, it is a purpose of this invention to provide features that will reduce or eliminate the above three problems.

It is a related purpose of this invention to provide these improvement features without detracting from the security and use facility of the invention disclosed in the '596 patent.

BRIEF DESCRIPTION

In brief, three main improvement features are involved.

A tab on the inner surface of the cover is at a position that is approximately opposite (180 degrees) from the opening in the cover sidewall that accommodates the tether of the pen. A channel defined by an inner sidewall in the base holds the cover tab and permits rotation of the cover between a pen replacement state and a pen installation position. Stops at the ends of the channel determine the scope of the cover rotations. Notches or openings at the ends of the channel resiliently hold the cover in position until sufficient force is applied to snap the tab out of the notch in which it is received.

One of the two base notches engages the tab so as to hold the cover in the replacement state which is the position where the pen is being replaced. The other notch is positioned so as to hold the cover in the installation position. The installation position is the position of the cover in the use state. The use state is achieved when, as described below, the transport is rotated to be engaged by a spring. In the use state, the transport wall locks the stop at the end of the tether into a recess in the base, the pen is securely held for use.

A spring on the inner wall of the base is positioned to engage an opening in the transport wall so that when the transport is rotated to provide a use state, the spring will resiliently engage the transport wall opening. Accordingly, movement of the transport will require a forcible enough twist to overcome the resilient holding of the spring in the wall opening and the transport will feel, to the typical user, as if it were fixed in place.

The stop at the end of the tether, which holds the tether of the pen in the base, is reconfigured. Specifically, instead of the tether stop in the shape of a ball, the stop has a flat outwardly facing surface that engages the wall of the recess in the base so that pulling on the tether will not wedge the stop into adjacent openings that accommodate the tether.

BRIEF DESCRIPTION OF THE DRAWINGS

FIG. 1 is taken along the broken plane surface shown as 8—8 in FIG. 7.

FIG. 9 shows the insertion of the tether 18 at the intermediate installation position where the base 22 and cover 26 are in their use position and the transport 24 has been rotated counterclockwise from its use position to this intermediate position preparatory to movement to the replacement state.

DESCRIPTION OF THE PREFERRED EMBODIMENTS

Figure 1:
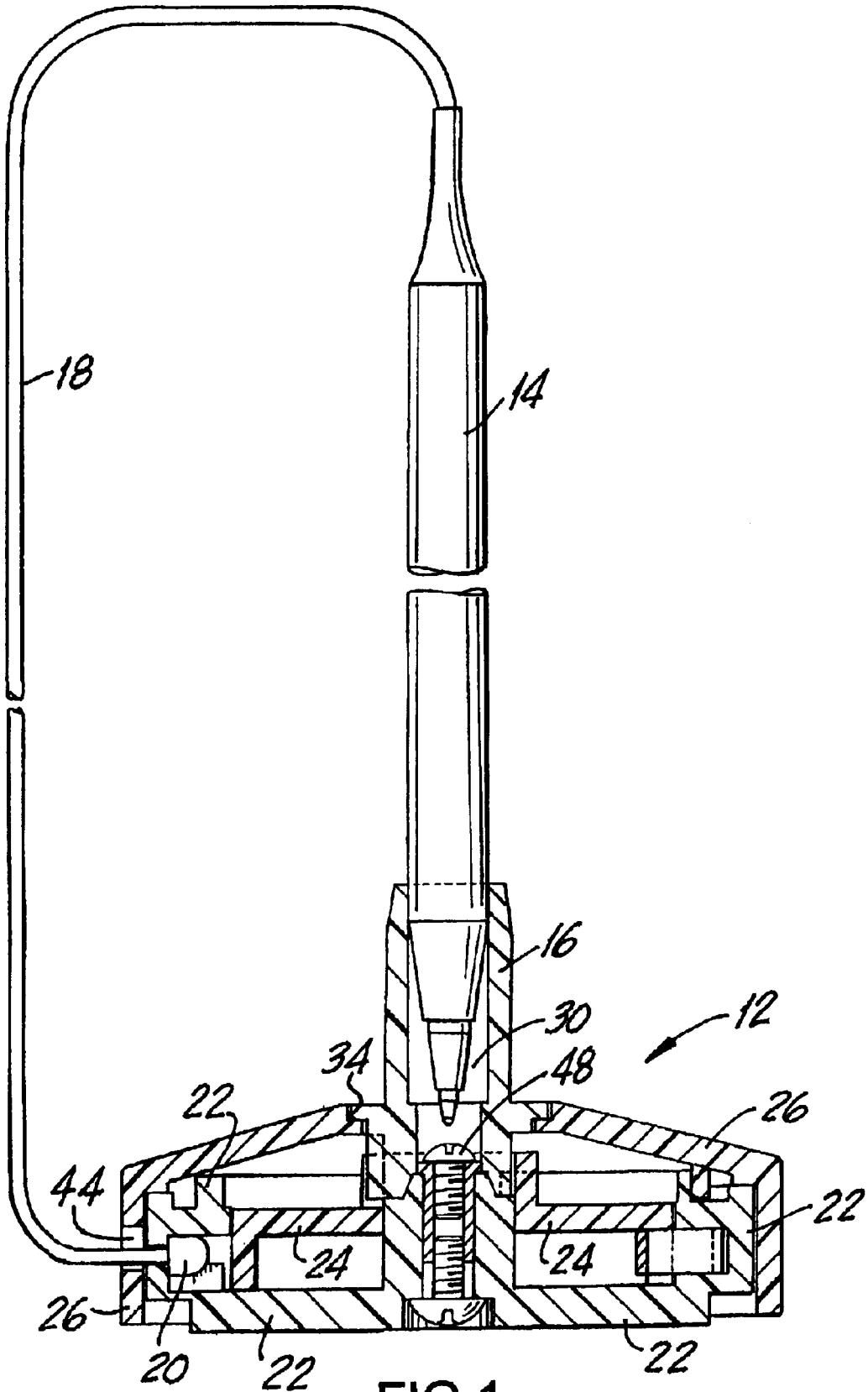
FIG. 1 is a vertical sectional view of the pen and pen holder 12 in the use state wherein the pen assembly 14, 18, 20 is retained in the holder 12 and the pen 14 is mounted in the pen receptacle 26 portion of the pen holder 12.

The FIGs. all represent the same embodiment. There is shown a pen assembly 14, 18, 20 and a pen holder 12. In FIG. 1, the pen assembly is shown with the pen element 14 mounted in a pen receptacle 16. A tether 18 which may be made of a molded security cable is affixed to the back end of the pen 14. The other end of the tether 18 is a stop 20 that is molded to the tether 18.

Figure 2:
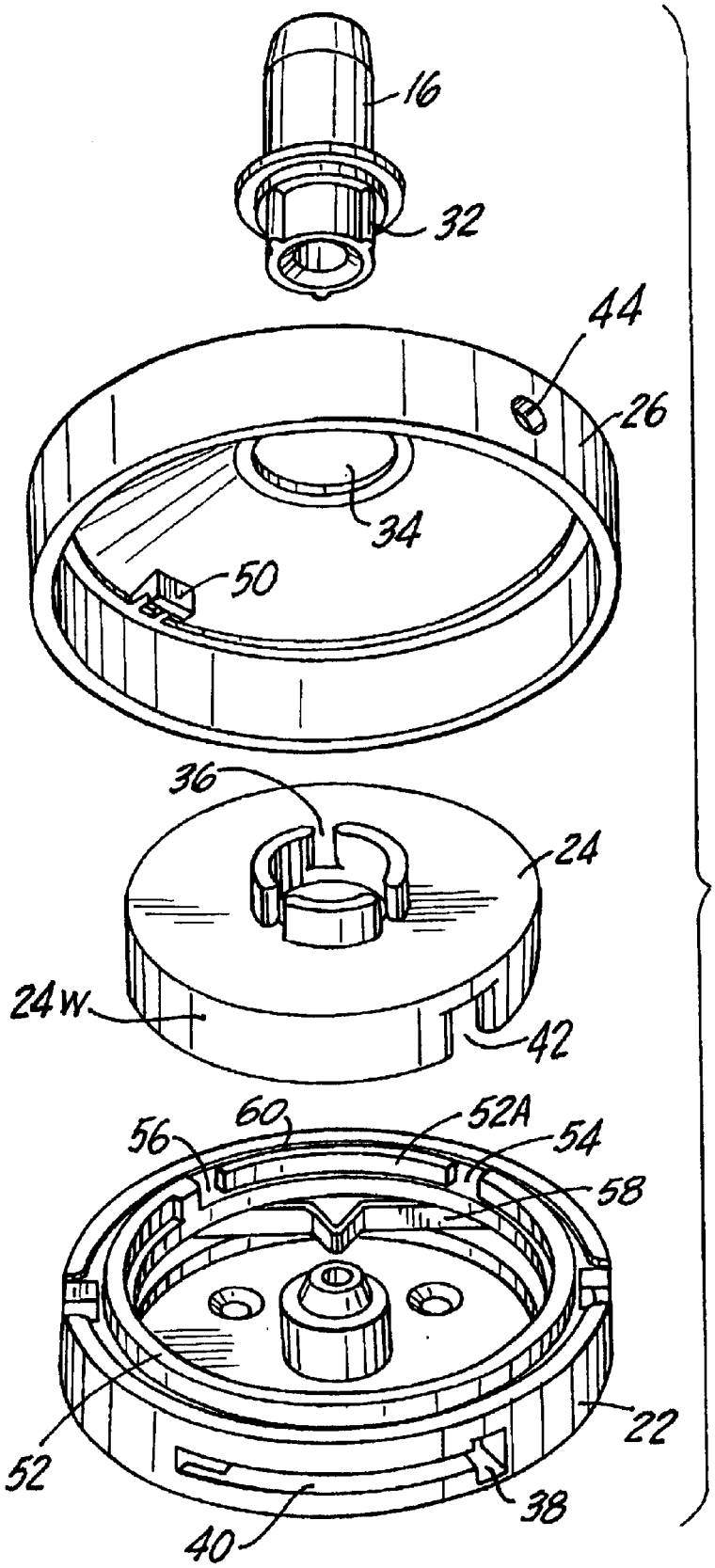
FIG. 2 is an exploded view of the ma in components of the pen holder looking down at the transport 24 and the base 22 but looking up at the pen receptacle 16 and the cover 26 so as to show the tab 50 on the inside of the cover 26.

As may best be seen in FIG. 2, the main elements of the pen holder 12 are shown in exploded fashion. These elements include a base 22, a transport element 24 that fits inside the base 22 and a cover 26 that fits over the base 22. A pen receptacle 16 is mounted on the cover 24 and has an opening 30 into which the forward end of the pen 14 can fit and be held in an upright position. The pen receptacle 16 also has a set of ridges 32 which operate as a key arrangement. When the elements of FIG. 2 are assembled, the key arrangement 32 passes through an opening 34 in the top of the cover 26 and engages a mating keyway 36 (a set of slots) in the transport element 24. The receptacle 16 serves as a knob to permit manual rotation of the transport 24.

An opening 38 that extends through the sidewall of the base 22 has a diameter great enough to permit the stop 20 to pass through. A slot 40 through the sidewall of the base 22 is a longitudinal slot that extends circumferentially approximately 90° around the sidewall of the base 22. The horizontal width of the slot 40 is sufficient to accommodate the diameter of the tether 18 so that the tether 18 can move along the slot. The slot 40 is small enough so that the stop 20 cannot be passed through the slot. Thus, when the tether extends through the slot 40 with the stop 20 on the inboard side of the base 22, the pen assembly is held in the pen holder 12.

Figure 4:
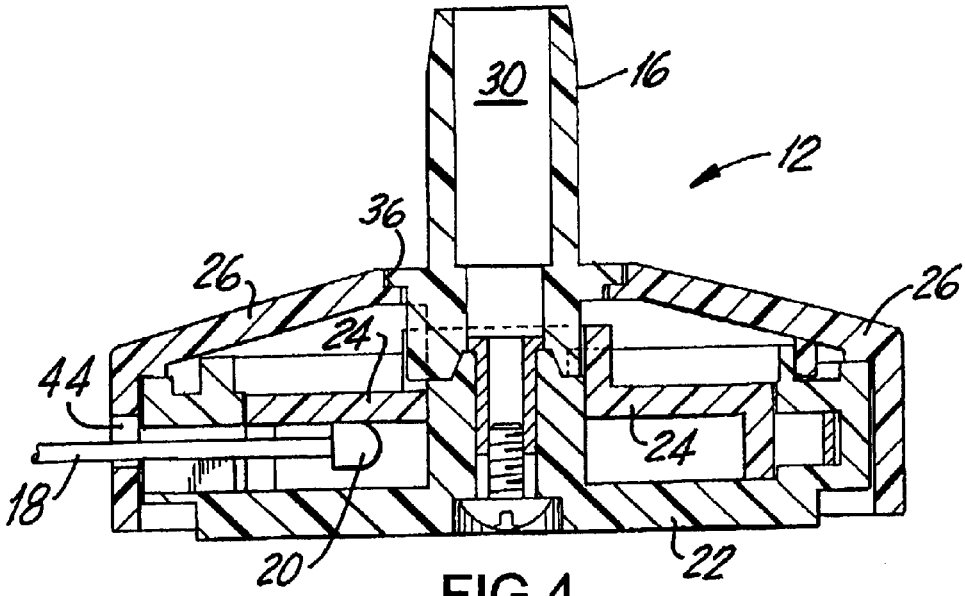
FIG. 4 is a vertical sectional view along the plane 4—4 of FIG. 3.
Figure 3A:
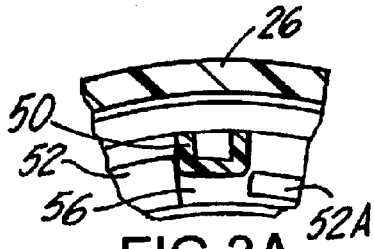
FIG. 3A is a simplified cross-sectional view in the plane of FIG. 3 showing the cover tab 50 held in position in the opening 56 of the wall 52.
Figure 3:
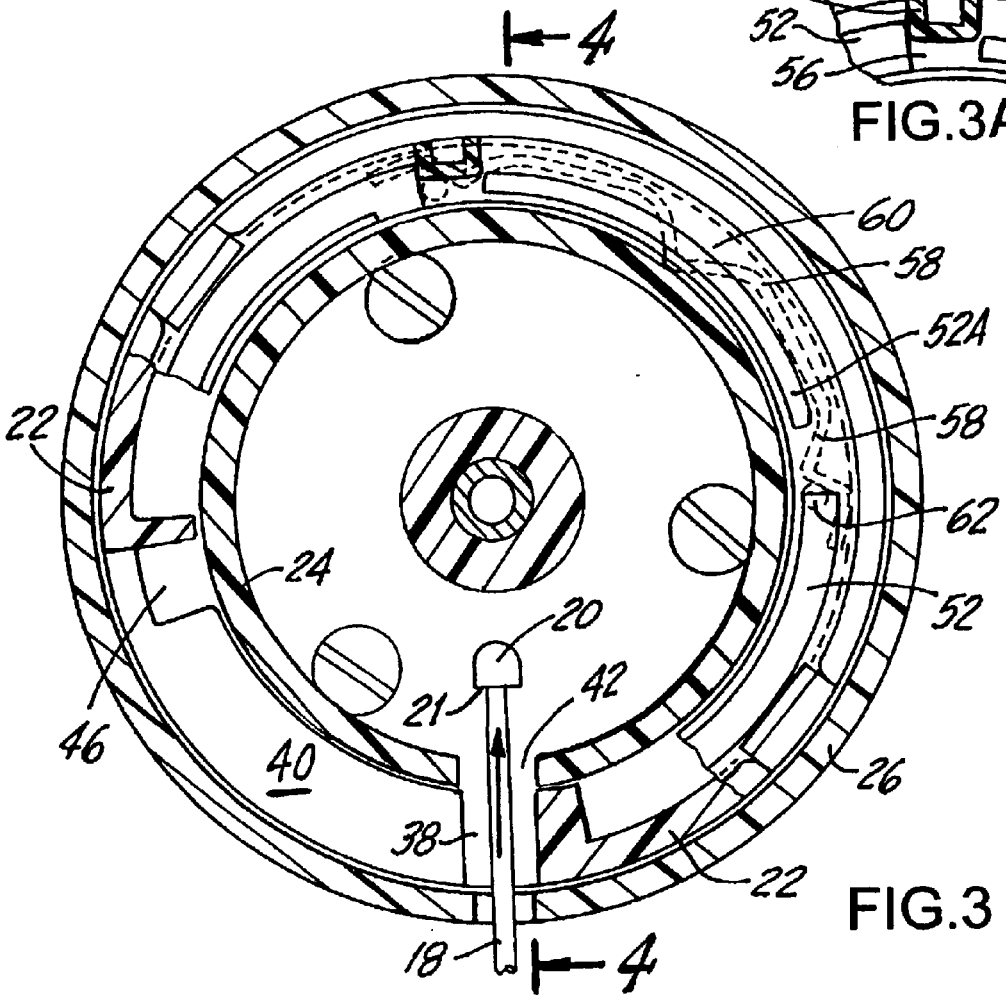
FIG. 3 is a cross-sectional view through the pen holder 12 in its pen replacement state with the stop 20 at the end of the pen assembly 14, 18, 20 fully inserted into the holder 12.

The transport 24 has an opening 42 in its sidewall 24W. The opening 42 is sized to pass the stop 20 therethrough when the stop 20 is inserted through the base opening 38. The cover 26 also has an opening 44; which opening has a diameter large enough to pass the stop 20 therethrough. When this pen holder is in its pen replacement state, as shown in FIGS. 3 and 4, the openings 44, 38 and 42 are radially aligned. The pen assembly stop 20 can thus be inserted far enough into the pen holder 12 so that the stop 20 is entirely received within the transport 24.

As can be seen in FIGS. 1 and 4, the pen receptacle 16 loosely fits within a top opening 34 of the cover 26 and the keys 32 engage the keyways 36 in the transport 24. This assures that the transport 24 can be rotated by manual rotation of the knob like upper portion of the pen receptacle 16. The center screw 48 (shown only in FIG. 1) is loosely inserted so that the head of the screw 48 will prevent the receptacle 16 from being removed. But the screw 48 does not bind the receptacle 16, so that the receptacle 16 can rotate freely about the periphery of the screw 48. That is, the screw threads only engage the base 22 and do not engage the receptacle 16.

When the tether stop 20 has been inserted fully into the transport 24 as shown in FIG. 3, the receptacle 16 can be manually rotated thereby forcing the transport 24 to rotate. The tether 18 engages the wall of the opening 44 in the cover 26 and thus pushes the cover 26 around with the transport 24.

Figure 6:
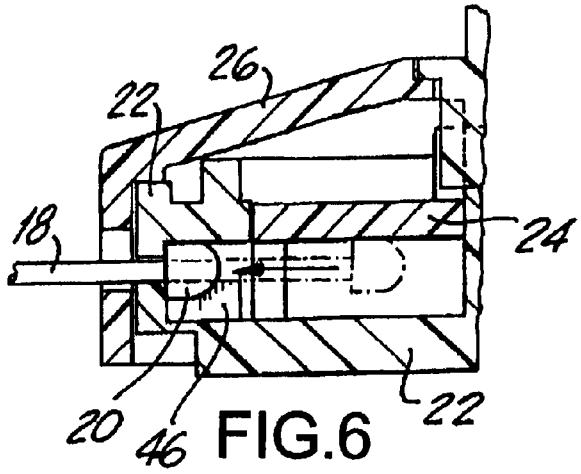
FIG. 6 is a sectional view along the plane 6—6 of FIG. 5.
Figure 5:
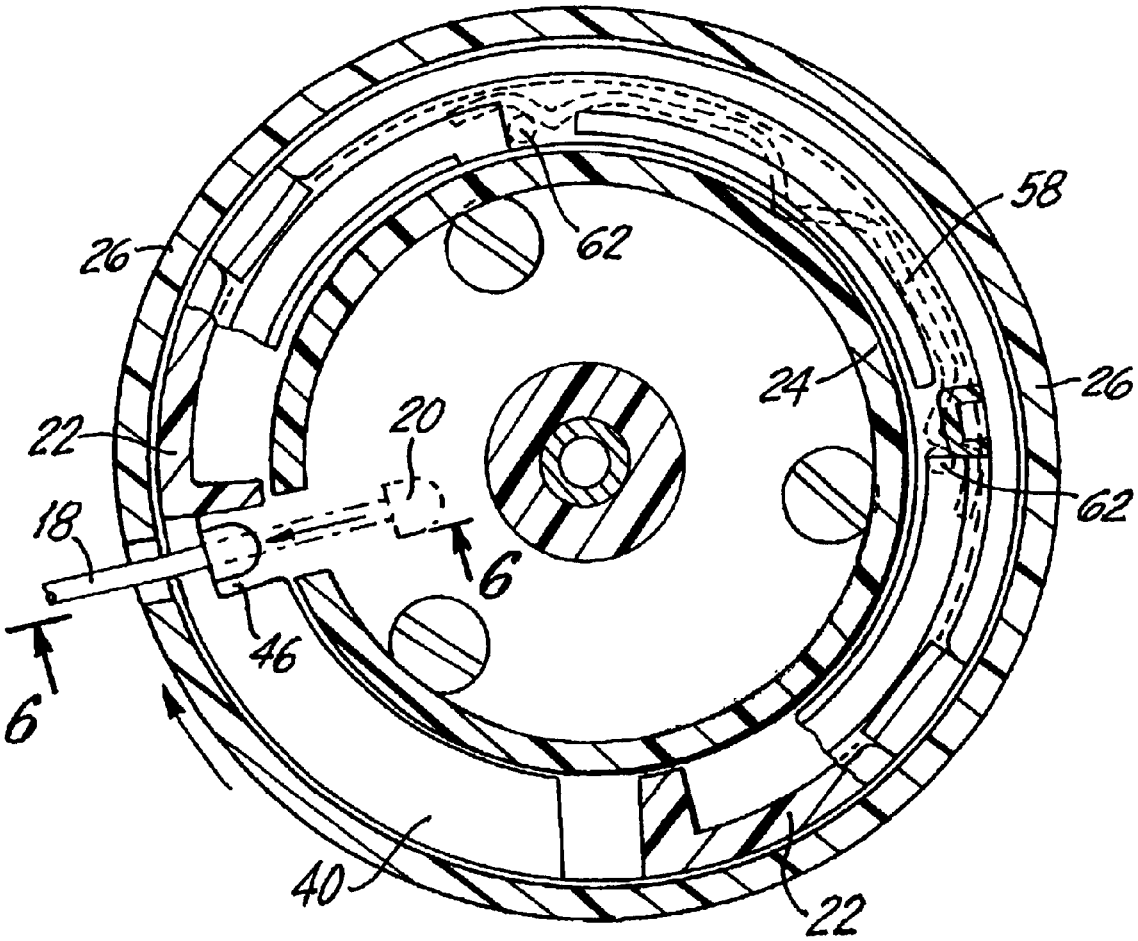
FIG. 5 is a cross-sectional view similar to that of FIG. 3 except that FIG. 5 shows the pen installation position in which the transport 24 and base cover 26 have been rotated clockwise approximately 90° from the pen replacement state shown in FIG. 3 and the tether 18 pulled radially out so that the stop 20 is in the recess 46 of the base 22.
Figure 8:
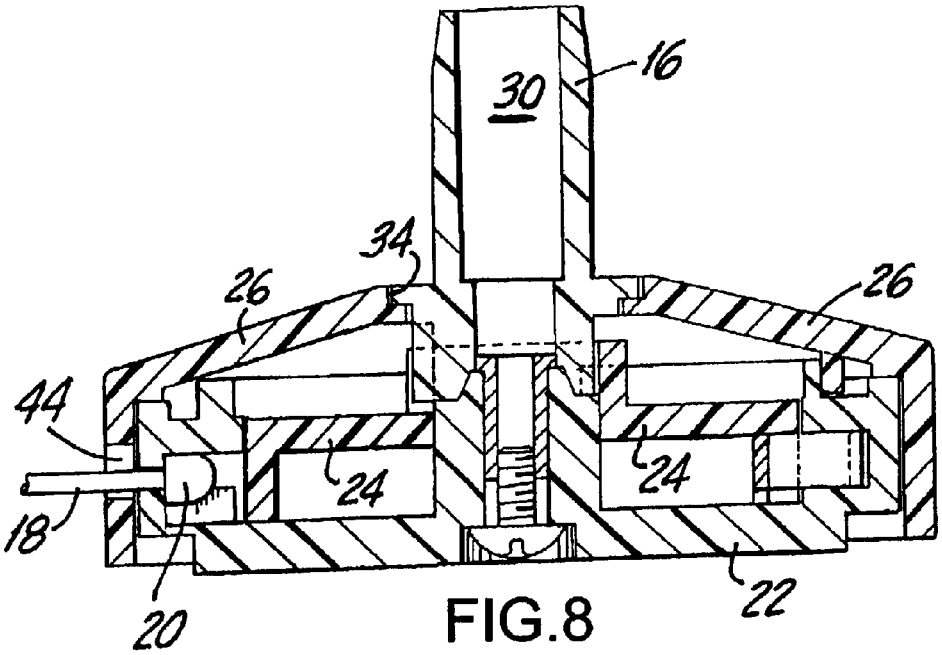
FIG. 8 is a sectional view along the broken plane surface 8—8 of FIG. 7.
Figure 7:
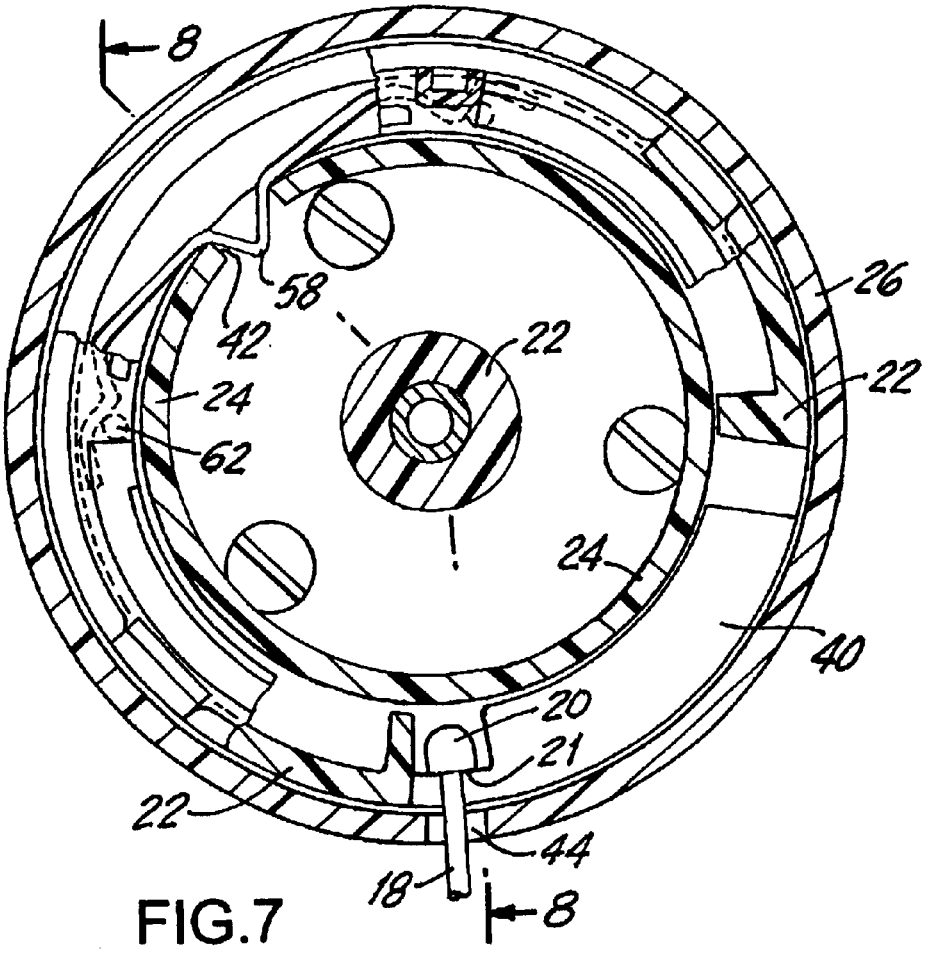
FIG. 7 is a cross-sectional view similar to that of FIGS. 3 and 5 showing the use state in which the transport 24 has been further rotated clockwise so that the opening 42 in the sidewall of the transport 24 engages the spring 58. In this state, the sidewall of the transport bocks the recess 46 thereby preventing the stop 20 of the pen assembly from being pushed radially inward. This prevents circumferential movement of the tether and thus inhibits manipulation of the pen assembly into the pen replacement state.
Figure 9:
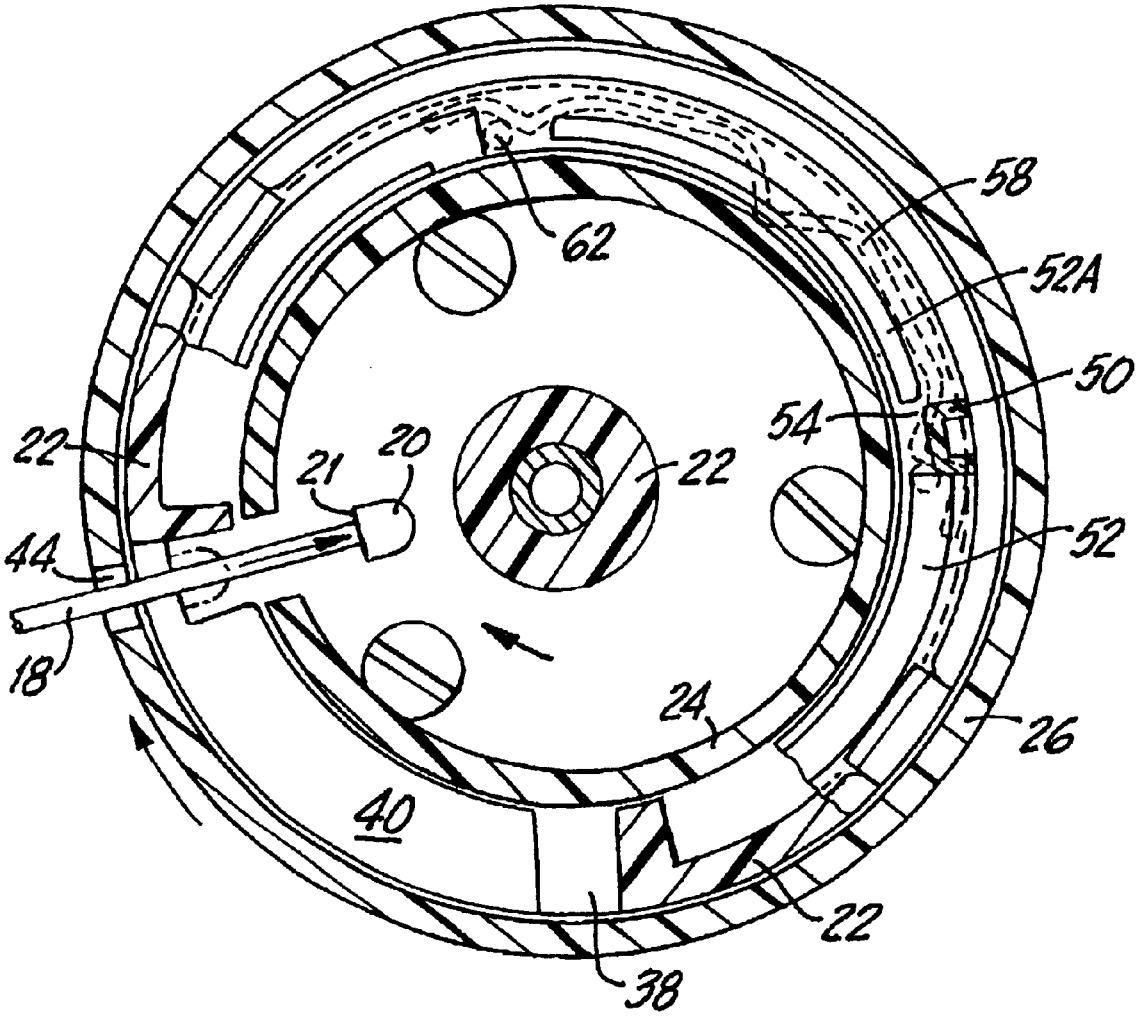
FIG. 9 is a cross-sectional view similar to that of FIGS. 3, 5 and 7 showing the relations after the transport 24 has been rotated counter-clockwise from the FIG. 7 use state.
Figure 10:
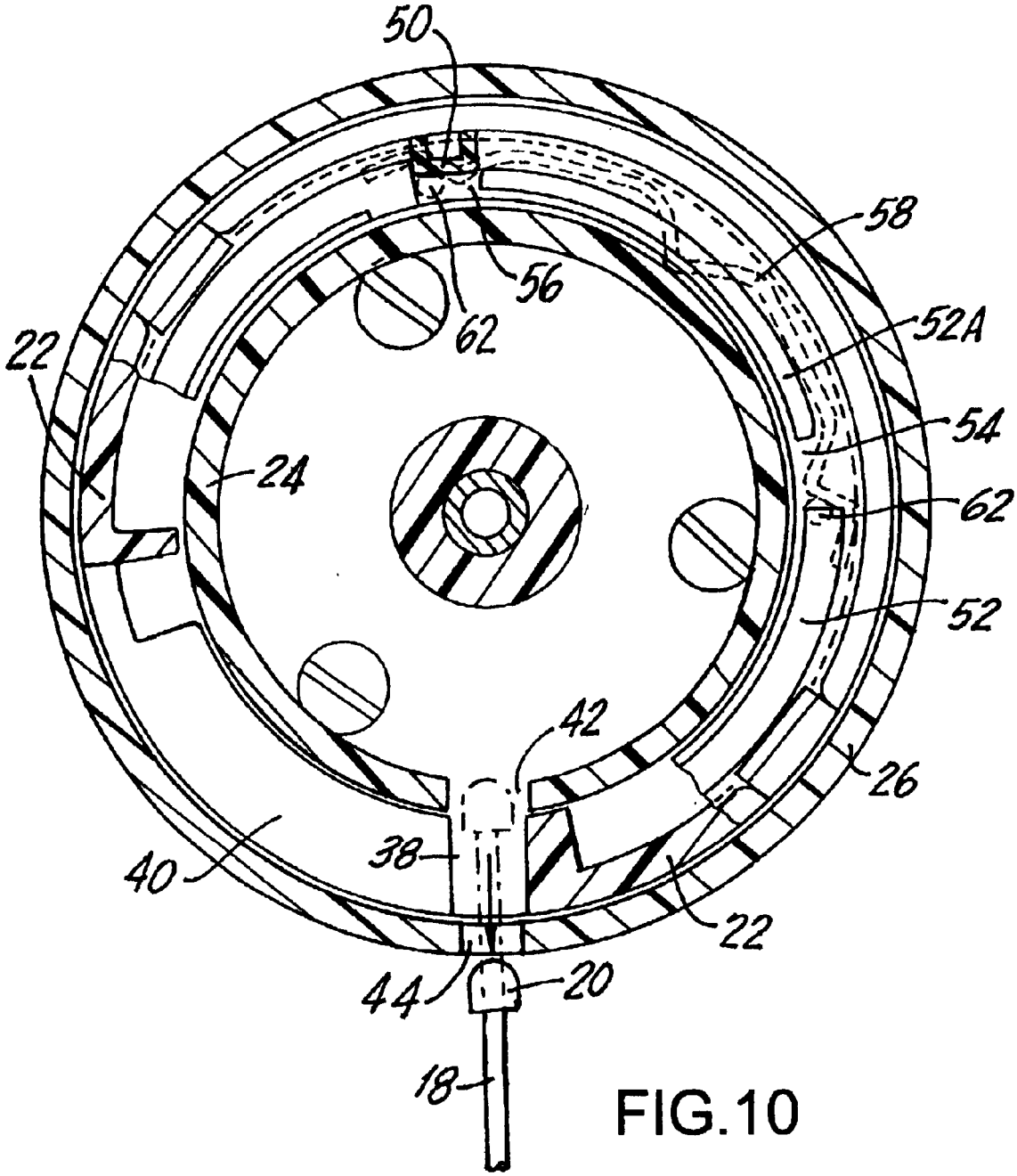
FIG. 10 is a cross-sectional view similar to that of FIGS. 3 and 9 showing the removal of the pen and its tether 18 when in the replacement state where the cover stop 50 has engaged the base wall opening 56 after traveling along the channel 60 from the base wall opening 54.

FIGS. 5 and 6 show the situation when the transport 24 and cover 26 have rotated clockwise about 80° to 90° and the tether stop 20 is in radial alignment with the recess 46 in the base 22. When the tether 18 and stop 20 are pulled radially outward then, as shown in FIG. 6, the stop 20 fits into the base recess 46 and is outboard of the transport 24. In this condition, further clockwise rotation of the pen receptacle 16 will cause further rotation of the transport 24 to a position such as shown in FIGS. 7 and 8. In this FIG. 7 pen use state, lateral motion of the tether 18 will not cause movement of the cover 26 or transport 24 and the holder 12 will not change state unless manually forced to do so. The pen retention or use state will be maintained.

The above description is similar to that contained in U.S. Pat. No. 6,167,596. However, in this improvement design, significant additional features include the tab 50 on the inside of the cover 26. The interior wall 52 on the base 22 which wall 52 includes a thinner segment 52A and also includes two openings 54 and 56 separated by the thinner wall portion 52A. A channel 60 between the thin wall 52A and the inner surface of the outer wall of the base 22 provides a track within which tab 50 rides.

Furthermore, as seen in FIG. 2, the base 22 also includes a spring element 58. The spring 58 is held in position by the posts 62 so that he spring will act in the resilient manner described below. These are the main structural features which distinguish over the design taught in the '596 patent.

In addition, the stop 20 has a flat engagement surface 21 so that a radiai outward pull on the tether 18 will not result in jamming the stop into the slot 40.

The following discussion of the operation of the pen holder having these additional features is set forth below to provide an understanding of the function of each of these additional features.

Operation

In operation, the openings in the sidewall of the cover 26, the base 22 and the transport 24 have to be aligned in order to insert and remove the tether stop 20. That is, the opening 44 in the cover 26, the opening 38 in the base 22 and the opening 42 in the transport 24 must be in radial alignment. When in alignment, the maintenance person holds the tether 18 and pushes the stop 20 in about two inches. The installer then rotates the cover 26 clockwise, looking down at the cover, to carry the tether 18 and stop 20 by 80° to 90° along the slot 42 to where the recess 46 in the base 22 is located. This is the rotational position where the pen 14 will be used and is referred herein as the installation position. During the rotation, the cover tab 50 rides in the channel 60 from engagement with the opening 52 to engagement with the opening 54. The cover tab 50 clicks into the opening 54 in the engagement wall 52 of the base 22 and thus provides a tactile and audible indication that the installation position has been achieved.

During the step of clockwise rotation from insertion state to installation position, the tether 18 engages the edge of the opening 42 in the transport 24 to cause the transport 24 to rotate. At this installation position, the cover opening 42 is in alignment with the recess 46 at the end of the base slot 40. But this is only an intermediate state. The tether 18 is then pulled radially out so that the stop 20 is positioned in the recess 46 of the base 22 radially outboard of the transport 24. The pen installer then by turning the pen holder 16 clockwise rotates the transport 24 another 90° clockwise until the base spring 58 engages the transport opening 42 to hold the transport 24 resiliently in place. This is a final or use state in which the transport 24 will not freely move. The sidewall 24W of the transport 24 is radially inward adjacent to the stop 20 to hold the stop 20 in the recess 46 of the base 22.

To replace the pen 14, the installer first rotates the transport 24 counterclockwise by turning the pen holder 16. The spring 58 flexes sufficiently so that under the force applied by the operator, the transport 24 will come free of the spring 58 and rotate counterclockwise. At the same time, the operator pushes the tether 18 and stop 20 radially inward. When the transport opening 42 rotates to a position adjacent to the stop 20, the stop 20 will move radially inward. When the stop 20 moves radially inward, the user rotates the cover 26 counterclockwise until the cover 44 aligns with the base opening 38 and the recess 42 so that the stop can be removed and the pen replaced. This pen replacement position is indicated by the cover tab 50 clicking into the opening 56 in the engagement wall 52 of the base 22. This inner wall 52 is called herein an engagement wall because it provides engagement between the tab 50 and the wall at wall openings 54 and 56.

In the process of rotating the cover between the position where the cover opening 44 is in alignment with the base opening 38 (that is, the pen replacement state) to the position where the cover opening 44 is in alignment with the base recess 46 at the end of the slot 40 (that is, the installation position), the tab 50 on the inside surface of the cover 26 clicks into engagement with the base inner wall 52 openings 54 and 56. It is this engagement which provides audible and tactile signals that tell the operator that the cover 26 is either in the replacement position or in the use position.

Accordingly, one of the advantages provided by the improvement of this invention is to give the installer a tactile and/or auditory confirmation of three separate positions.

The engagement between cover tab 50 and engagement wall opening 56 indicates the pen replacement state.

The engagement between cover tab 50 and engagement wall opening 54 indicates the intermediate installation position, which is the use position of the pen.

The engagement between transport wall opening 42 and spring 58 indicates the final use state position.

It is preferable to have the cover limited to a traverse over the arc between the two openings 56 and 54 on the top of the sidewall 52 within the base 22.

Accordingly, the larger arc of the engagement wall 52 is thicker than the smaller arc 52A. This provides a stop defined by the edges of the thicker sidewall 52 and prevents the tab 50 from rotating past the arc defined by the gaps 56 and 54.

The channel 60 between the outer wall and inner wall 52A of the base resiliently accommodates the tab 50 on the cover. This engagement provides friction as the tab 50 travels within the channel 60 between the two openings 56 and 54 and thus requires positive action by the installer.

For ease of molding, the base is composed of a main body and a secondary body. In assembly, the secondary body is snapped into the main body and glued in place to provide a more unitary base. Such molding techniques are known in the art.

The portion of the inner wall 52 on the base 22 that is between the openings 54 and 56 is designated as wall portion 52A. This wall portion 52A is thinner than the adjacent portions of the wall 52 so that the tab 50 on the cover 26 can only travel along the wall portion 52A between the two openings 54 and 56. The tab 50 will be stopped by the edges of the thicker portion of the wall 52 from rotation outside of the arc defined by the thinner wall portion 52A.

The plastic flexibility of the components in the design will permit the operator to disengage the tab 50 from the openings 54 and 56, but only when traveling from one of the openings along the wall portion 52A to the other opening.

While the foregoing description and drawings represent the presently preferred embodiments of the invention, it should be understood that those skilled in the art will be able to make changes and modifications to those embodiments without departing from the teachings of the invention and the scope of the claims.

What is claimed is:

1. In a pen and pen holder system, the pen holder having a base sidewall sandwiched between a cover sidewall and a transport sidewall, the cover and transport being rotatable relative to the base between a pen replacement state and a pen use state, the pen being coupled to the pen holder by a tether and a stop, the improvement comprising:

a cover engagement member on the inner surface of the cover, first and second base engagement members on the base, said cover engagement member and said first base engagement member resiliently engaging each other when the pen holder is in the replacement state, said cover engagement member and said second base engagement member resiliently engaging each other when said pen holder is in the use state, a transport engagement member on the transport, a third base engagement member on the base, said transport engagement member and said third base engagement member resiliently engaging each other when the pen holder is in the use state, to position a wall of said transport adjacent to the stop of the pen in said use state thereby preventing inward movement of the tether of the pen in said use state.

2. The improvement of claim 1 wherein: said cover engagement member is a tab and said first and second base engagement members are stops.

3. The improvement of claim 1 wherein: said cover engagement member is a tab and further comprising an interior base wall member and wherein said first and second base engagement members are openings in said interior base wall member.

4. The improvement of claim 1 wherein: said third base engagement member is a spring and said transport engagement member is an opening in the sidewall of the transport.

5. The improvement of claim 3 wherein: said third base engagement member is a spring and said transport engagement member is an opening in the sidewall of the transport.

6. The improvement of claim 1 wherein: the engagement of each of said resilient engagements provides an audible click and tactile response to confirm to a person who replaces the pen that the particular state has been achieved.

7. In a pen and pen holder system, the pen holder having a base sidewall sandwiched between a cover sidewall and a transport sidewall, the cover and transport being rotatable relative to the base between a pen replacement state and a pen use state; openings in the transport sidewall, base sidewall and cover sidewall being in alignment in the replacement state; the improvement comprising:

a tab on the inner surface of the cover, an engagement wall of the base having a set of two openings, said tab resiliently engaging said openings at first and second rotational positions of the cover to hold the cover in first and second positions to resist rotational movement of the cover in said positions, said first position being in the replacement state and said second position being in the use state, said openings at said first and second rotational positions of the cover further serving as stops to limit rotation of said cover along a predetermined arc between said use and replacement states.

8. The improvement of claim 7 further comprising:

a spring mounted in the base, the sidewall transport having an opening, rotation of the transport bringing said opening of said transport into engagement with said spring to resiliently hold the transport in the use state and thereby provide a predetermined resistance to rotational movement of the transport.

9. In a pen and pen holder system, the pen holder having a base sidewall sandwiched between a cover sidewall and a transport sidewall, the cover and transport being rotatable relative to said base between a pen replacement position and a pen use position, the improvement comprising:

a first engagement/disengagement mechanism between the cover and the base to align openings in the cover transport and base in the pen replacement position, a second engagement/disengagement mechanism between the cover and the base at a predetermined rotational distance from said firs engagement/disengagement mechanism to provide a predetermined position of the cover on the base in the pen use position, in which the openings of the cover and base are out of alignment, and a third engagement/disengagement mechanism between the base and the transport to provide a holding position for the transport in the pen use position in which the openings of the transport and base are out of alignment.

10. The improvement of claim 9 wherein:

said first engagement/disengagement mechanism comprises: a tab on the inner surface of the cover and a first gap in a wall of the base, said tab engaging said first gap when the system is in said pen replacement position, said second engagement/disengagement mechanism comprises: said tab on the inner surface of said cover and a second gap in said wall of the base, said tab engaging said second gap when the system is in the pen use position, and said third engagement/disengagement mechanism comprises: a spring in the sidewall of said base and an opening in the sidewall of the transport, said spring engaging said opening when the transport is in the use position.

11. In a pen and pen holder system, the pen holder having a base sidewall sandwiched between a cover sidewall and a transport sidewall, the cover sidewall having an opening, the base sidewall having an opening and the transport sidewall having an opening, the cover and transport being rotatable relative to the base between a pen replacement state wherein said cover opening, said base opening and said transport opening are in radial alignment and a pen use state wherein said cover opening and said base opening are out of radial alignment, an elongated circumferential slot through said base sidewall extending circumferentially from said base sidewall opening to an end point; the pen being coupled to the pen holder by a tether and a stop; the improvement comprising:

a first resilient engagement device responsive to rotation of the cover to engage the cover and the base in the pen replacement state, a second resilient engagement device responsive to rotation of the cover to engage the cover and the base in the pen use state, a third resilient engagement device responsive to rotation of the transport to engage the transport and the base in the use state to position the sidewall of the transport adjacent to the stop of the pen and thus prevent inward radial movement of the pen stop in the use state.

12. The improvement of claim 11 wherein: the engagement of each of said three engagement devices provides an audible click and tactile response to confirm to a person who replaces the pen that the particular state has been achieved.

13. The improvement of claim 11 wherein: the resilience of each of said engagement mechanisms permits manual movement out of each of said engagements.

14. The improvement of claim 12 wherein: the resilience of each of said engagement mechanisms permits manual movement out of each of said engagements.

15. The improvement of claim 11 wherein: the cover opening and base opening are through openings.

* * * * *